US008695610B2

(12) United States Patent
Samain et al.

(10) Patent No.: US 8,695,610 B2
(45) Date of Patent: Apr. 15, 2014

(54) METHOD OF APPLYING MAKEUP AND APPARATUS FOR IMPLEMENTING SUCH A METHOD

(75) Inventors: Henri Samain, Bievres (FR); Didier Gagnebien, Sceaux (FR)

(73) Assignee: L'Oreal, Paris (FR)

( * ) Notice: Subject to any disclaimer, the term of this patent is extended or adjusted under 35 U.S.C. 154(b) by 471 days.

(21) Appl. No.: 13/001,720

(22) PCT Filed: Jul. 10, 2009

(86) PCT No.: PCT/IB2009/053011

§ 371 (c)(1),
(2), (4) Date: Feb. 28, 2011

(87) PCT Pub. No.: WO2010/004526

PCT Pub. Date: Jan. 14, 2010

(65) Prior Publication Data

US 2011/0164263 A1 Jul. 7, 2011

Related U.S. Application Data

(60) Provisional application No. 61/082,519, filed on Jul. 22, 2008.

(30) Foreign Application Priority Data

Jul. 10, 2008 (FR) ..... 08 03950

(51) Int. Cl.

| | |
|---|---|
| ***A45D 24/00*** | (2006.01) |
| ***A45D 40/24*** | (2006.01) |
| ***A61B 5/00*** | (2006.01) |
| ***B41J 2/01*** | (2006.01) |

(52) U.S. Cl.
USPC ..... 132/200; 132/317; 600/310; 427/1

(58) Field of Classification Search
USPC ..... 132/200, 333, 73, 317, 318, 320; 600/476, 310, 587, 317, 306; 356/425; 607/88, 89, 109; 434/98–100; 382/118, 382/313; 601/17; 347/109, 240, 245, 110, 347/1; 348/77
See application file for complete search history.

(56) References Cited

U.S. PATENT DOCUMENTS 4,276,570 A 6/1981 Burson et al.
5,478,238 A * 12/1995 Gourtou et al. ..... 434/100

(Continued)

FOREIGN PATENT DOCUMENTS

DE 101 53 249 A1 5/2003
EP 1 210 908 A2 6/2002

(Continued)

OTHER PUBLICATIONS

Nov. 2, 2012 Office Action issued in U.S. Appl. No. 13/001,727.

(Continued)

*Primary Examiner* — Vanitha Elgart
(74) *Attorney, Agent, or Firm* — Oliff PLC

(57) ABSTRACT

A method of making up the skin or the lips, the method including measuring at least one optical characteristic at least one location of the skin or the lips; and automatically forming on the skin or lips a deposit that has an optical characteristic that varies and that corresponds substantially at said location, to the measured optical characteristic.

15 Claims, 4 Drawing Sheets

(56) References Cited

U.S. PATENT DOCUMENTS

| | | | | |
|---|---|---|---|---|
| 5,836,872 | A | 11/1998 | Kenet et al. | |
| 5,931,166 | A | 8/1999 | Weber et al. | |
| 6,035,860 | A | 3/2000 | Mombourquette | |
| 6,128,516 | A * | 10/2000 | Macfarlane et al. | 600/310 |
| 6,543,893 | B2 | 4/2003 | Desormeaux | |
| 6,622,733 | B2 | 9/2003 | Saksa | |
| 7,290,550 | B2 | 11/2007 | Sim | |
| 7,349,857 | B2 * | 3/2008 | Manzo | 705/2 |
| 7,454,046 | B2 * | 11/2008 | Chhibber et al. | 382/128 |
| 7,648,364 | B2 | 1/2010 | Dauga et al. | |
| 7,738,032 | B2 | 6/2010 | Kollias et al. | |
| 7,856,118 | B2 * | 12/2010 | Kalla et al. | 382/100 |
| 7,890,152 | B2 * | 2/2011 | Edgar et al. | 600/310 |
| 8,007,062 | B2 * | 8/2011 | Edgar et al. | 347/1 |
| 8,027,505 | B2 | 9/2011 | Edgar et al. | |
| 8,094,186 | B2 * | 1/2012 | Fukuoka et al. | 348/77 |
| 8,094,879 | B2 * | 1/2012 | Kalla et al. | 382/100 |
| 8,155,413 | B2 * | 4/2012 | Chhibber et al. | 382/128 |
| 8,231,292 | B2 * | 7/2012 | Rabe et al. | 401/19 |
| 8,260,010 | B2 * | 9/2012 | Chhibber et al. | 382/118 |
| 8,373,859 | B2 * | 2/2013 | Chhibber et al. | 356/366 |
| 2002/0155069 | A1 | 10/2002 | Pruche et al. | |
| 2003/0108542 | A1 | 6/2003 | Pruche et al. | |
| 2004/0078278 | A1 | 4/2004 | Dauga et al. | |
| 2005/0053628 | A1 | 3/2005 | Montanari et al. | |
| 2005/0148908 | A1 * | 7/2005 | Skover et al. | 601/17 |
| 2006/0098076 | A1 | 5/2006 | Liang | |
| 2006/0246020 | A1 | 11/2006 | Cole et al. | |
| 2006/0274071 | A1 | 12/2006 | Bazin | |
| 2007/0035815 | A1 | 2/2007 | Edgar et al. | |
| 2007/0049832 | A1 | 3/2007 | Edgar et al. | |
| 2007/0114305 | A1 | 5/2007 | Yamaguchi et al. | |
| 2007/0258656 | A1 | 11/2007 | Aarabi | |
| 2008/0024583 | A1 * | 1/2008 | Noe et al. | 347/109 |
| 2008/0193195 | A1 * | 8/2008 | Edgar et al. | 401/119 |
| 2008/0212894 | A1 | 9/2008 | Demirli et al. | |
| 2008/0219528 | A1 * | 9/2008 | Edgar et al. | 382/128 |
| 2009/0054744 | A1 * | 2/2009 | Kitamura et al. | 600/306 |
| 2009/0118600 | A1 * | 5/2009 | Ortiz et al. | 600/306 |
| 2009/0279760 | A1 | 11/2009 | Bergman | |
| 2009/0280150 | A1 * | 11/2009 | Kamen et al. | 424/401 |
| 2010/0185064 | A1 * | 7/2010 | Bandic et al. | 600/306 |
| 2010/0243514 | A1 * | 9/2010 | Samain et al. | 206/581 |
| 2010/0252061 | A1 * | 10/2010 | Samain et al. | 132/200 |
| 2010/0271470 | A1 * | 10/2010 | Stephan et al. | 348/77 |
| 2011/0124989 | A1 * | 5/2011 | Edgar et al. | 600/310 |
| 2011/0129283 | A1 * | 6/2011 | Samain | 401/5 |
| 2011/0159463 | A1 * | 6/2011 | Samain | 434/100 |
| 2011/0162673 | A1 * | 7/2011 | Samain et al. | 132/317 |
| 2012/0017929 | A1 * | 1/2012 | Samain et al. | 132/200 |
| 2012/0024308 | A1 * | 2/2012 | Giron et al. | 132/200 |
| 2012/0044335 | A1 * | 2/2012 | Goto | 348/77 |
| 2012/0067364 | A1 * | 3/2012 | Wong | 132/200 |
| 2012/0250022 | A1 * | 10/2012 | Zhou et al. | 356/425 |

FOREIGN PATENT DOCUMENTS

| | | | |
|---|---|---|---|
| EP | 1 298 587 | A2 | 4/2003 |
| EP | 1 310 212 | A1 | 5/2003 |
| EP | 1 459 782 | A2 | 9/2004 |
| FR | 2 603 183 | A1 | 3/1988 |
| FR | 2 810 761 | A1 | 12/2001 |
| FR | 2 861 883 | A1 | 5/2005 |
| GB | 2 343 657 | A | 5/2000 |
| JP | A-2006-297691 | | 11/2006 |
| WO | WO 02/00189 | A1 | 1/2002 |
| WO | WO 02/01499 | A2 | 1/2002 |
| WO | WO 03/033270 | A1 | 4/2003 |
| WO | WO 2004/090629 | A2 | 10/2004 |
| WO | WO 2007/022095 | A1 | 2/2007 |
| WO | WO 2007/056569 | A2 | 5/2007 |

OTHER PUBLICATIONS

H. Katerinopoulos, *Current Medicinal Chemistry*, 2002, vol. 9, pp. 275-306.

International Search Report issued in PCT/IB2009/053011, dated Nov. 2, 2009.

International Search Report issued in PCT/IB2009/053012, dated Nov. 2, 2009.

International Search Report issued in PCT/IB2009/053015, dated Oct. 30, 2009.

International Search Report issued in PCT/IB2009/053014, dated Nov. 2, 2009.

International Search Report issued in PCT/IB2009/053013, dated Sep. 30, 2009.

Written Opinion issued in PCT/IB2009/053011, dated Nov. 2, 2009.

Written Opinion issued in PCT/IB2009/053012, dated Nov. 2, 2009.

Written Opinion issued in PCT/IB2009/053015, dated Oct. 30, 2009.

Written Opinion issued in PCT/IB2009/053014, dated Nov. 2, 2009.

Written Opinion issued in PCT/IB2009/053013, dated Sep. 30, 2009.

U.S. Appl. No. 13/001,671, filed Dec. 28, 2010 in the name of Henri Samain.

U.S. Appl. No. 13/001,727, filed Dec. 28, 2010 in the name of Henri Samain et al.

U.S. Appl. No. 13/001,688, filed Dec. 28, 2030 in the name of Henri Samain.

Jun. 25, 2013 Office Action issued in U.S. Appl. No. 13/001,727.

Dec. 24, 2013 Office Action issued in U.S. Appl. No. 13/001,671.

http://www.utexas.edu/opa/blogs/culturalcompass/2010/01/27/hair-and-makeup-test-photos-from-gone-with-the-wind/.

* cited by examiner

METHOD OF APPLYING MAKEUP AND APPARATUS FOR IMPLEMENTING SUCH A METHOD

The present invention relates to methods of applying makeup and to apparatuses for implementing such methods.

BACKGROUND

It is desired to bring color to the skin, e.g. to make it more uniform, and also to look good, to provide coloring that is cheerful, to increase contrast with other colors of the body or clothing, or to match the colors of the face with those of the lips, for example.

The skin may also be made up to reduce the impression of face volume, or on the contrary to increase it. It is known that adding certain colors, if suitably placed on the face, can create impressions of volume. To be effective, these effects require makeup to be applied well, both concerning the choice of colors and where they are placed.

Colors may also be applied on a foundation, e.g. to limit the flat effect and recreate an appearance that is more natural.

In makeup routines, it is common practice to use powders of fluids to apply these touches of color, e.g. to the cheeks, around the eyes, or on other locations of the body or the face.

It is not easy to apply colored material without leaving a line of demarcation with the region that has not been made up. However it is often desired to avoid any such demarcation being visible.

For example, achieving a "rosy cheeks" type effect is difficult since it is necessary to apply the touch of color in delicate manner if no lines of demarcation are to be seen.

The difficulty is associated with the way in which colored compositions are applied and the way colors are chosen so that the edges of the colored area are identical in color to the color of the skin. It is also necessary for color within the colored area to vary gradually.

Thus, it is not appropriate merely to apply a mark of "red" color in the middle of the cheek. It is necessary for the color to be shaded off so that it tends towards the color of the skin at the edges of the colored area.

Brushes are quite effective since, when the user knows how to handle them, they enable the visibility of edges to be reduced. With a brush, pressure determines the quantity of powder that is delivered. Since the cheeks are sensitive to pressure from the bristles of the brush, the user can monitor pressure and cause application to be marked in the center of the cheek and to become lighter on going away from the center. This creates an effect that is shaded off, if not in terms of color, then at least in terms of intensity.

Use of a brush, although advantageous in that it makes it possible to apply compositions subtly, is nevertheless restricted since it works only with powders. As a result the color is not firmly secured to the skin. Furthermore, using a brush does not prevent blotches or traces of excess color forming, and thus often requires retouching to be performed. In addition, the brushes used tend to be rather large, which does not make it easy to produce specific patterns.

Attempts have been made to find new ways of applying makeup powders or fluids, in particular by using electrostatic sprays. Like an airbrush, an electrostatic spray delivers a jet of fluid that becomes deposited on the skin. By varying the distance between the appliance and the skin, it is possible to adjust the intensity with which the skin is covered by the composition and thereby limit the visibility of lines of demarcation. Nevertheless, the results are somewhat disappointing since the user cannot see accurately how far the appliance is from the skin.

Makeup specialists can obtain results of high quality and those results can transform the beauty of a face, however that requires long makeup sessions and professional know-how. For a woman making herself up in the bathroom, circumstances are generally unsuitable for such work. It can thus be seen that women are thus not able to take best advantage of the techniques available for improving their looks.

Consequently there exists a need to benefit from methods and apparatuses making it easy to apply color in a manner that is satisfactory in terms of appearance.

Publication WO 2007/022095 A1 discloses a method of applying makeup in which an agent that modifies the reflectance of the skin is applied to the skin by using ink jet printer technology. In one embodiment, the device includes a scanner and an ink jet printer, and in a single pass over the skin it analyses the skin, identifies unattractive characteristics, calculates the improvements to be made, and applies the agent that modifies reflectance so as to obtain those improvements. For example, the device can give a softer appearance to the skin by identifying pale and dark points and by applying the reflectance-modifying agent so as to darken pale points using a predefined averaging technique. The device may include means for recognizing the treated zone, e.g. the cheek bone or the cheek so that the improvements made are specific to the zone being treated, e.g. making cheeks look rosy so as to give the appearance of a person in better health, or darkening zones under the cheek bones so as to make them less prominent. A colorant may be deposited on certain portions of the skin to make it more uniform and markers that fluoresce under ultraviolet illumination may be used to make it easier to recognize certain regions during treatment. In an example seeking to simulate tanning, an agent that modifies the spectral characteristics of the skin is applied so as to reduce contrast between pale and dark zones, darkening zones of the skin in selective manner, while causing certain details of the skin to disappear. In another element, pale zones around wrinkles are darkened but the hollow zones within wrinkles are not modified.

Publication WO 2004/090629 A2 discloses a method of printing on the skin.

U.S. Pat. No. 6,543,893 describes an ink jet printer suitable for being moved manually over the skin. The printer may have a screen for displaying images that are to be printed and a device that enables the image to be personalized, e.g. by adding text or other information. U.S. Pat. No. 6,622,733 describes an applicator having an ink jet printer head.

Application US 2006/0098076 discloses a system for ink jet printing on the skin that includes means for positioning the face. The printer system is suitable for printing hairs on the eyebrows or for printing color on the cheeks for blending in with a brush.

Application WO 02/01499 A2 describes a method of applying makeup by means of a movable applicator head supported by an arm that is articulated so as to follow the three-dimensional shape of the zone being made up. The three-dimensional shape is acquired with the help of one or more cameras. A design selected by the user can be printed using an ink jet. The printing may serve to cover a pigment mark with the same color as the surrounding skin, after performing colorimetric analysis thereon.

Application DE 10153249 A1 describes a method of applying compositions on the skin by means of an ink jet printing technique. Printing may be performed using a handpiece held by the user. In a variant, the print head may move relative to the skin by moving a belt or a carriage on a rail that is itself movable on two slideways at its ends.

Publication JP 2006-297691 discloses a printer system for printing an image on the skin, the system being fitted with means that enable the color of the skin to be measured. The printer system takes account of the color of the skin in the image that is to be reproduced, the print head being provided with a photodetector. For example, for a dark skin, the quantity of ink is increased. In a variant, not only is the lightness of the skin taken into consideration but also its color when calculating the image for printing.

Publication GB 2 343 657 describes a portable ink jet printer suitable for printing a mark authorizing entry to a concert or a discotheque on the forearm or the hand of a person. The ink that is deposited may be visible, fluorescent, magnetic, phosphorescent, or photochromic.

Application WO 02/00189 A1 describes a method of applying a colored composition on the skin in which it is possible to select a blemish on an image of the zone for treatment, which image is obtained by means of a camera that also measures color. Image modification software makes it possible to correct a blemish in the zone for treatment, e.g. a depigmented zone, by outlining the zone with the help of a computer mouse and then printing on the corrected zone the color of the surrounding zone.

Publication WO 03/033270 discloses an ink jet printer that can be positioned manually on the skin in order to print a tattoo.

Publication US 2007/0114305 describes an electrostatic spray device for making up the skin.

U.S. Pat. No. 7,290,550 discloses an installation capable of printing on the skin, in particular on the skin of the face.

Numerous appliances are also known for printing on the nails, e.g. from U.S. Pat. Nos. 5,931,166 and 6,035,860.

SUMMARY

First exemplary implementations of the invention provide a method of making up the skin or the lips, the method comprising:

- measuring at least one optical characteristic, for example color or gloss, at least one location of the skin or the lips; and
- automatically forming (i.e. by a system that is automatically controlled) on the skin or the lips a deposit that has an optical characteristic, for example color or gloss, that varies and that corresponds substantially at said location, to the measured optical characteristic.

The term "automatically forming" should be understood as the deposit being formed by a system under automatic control, possibly with the user confirming the image for printing. The method may thus propose an image for printing to the user, and the user can confirm the image before it is printed.

The invention enables makeup to be applied in careful and well-controlled manner that satisfies the need for a natural effect, since it causes boundaries substantially to disappear, lines of demarcation no longer being clearly visible, but without that causing color or gloss effects to be sacrificed.

The user may deposit colors or compositions for providing a glossy or mat look that is very different from the color or the gloss of the skin, while nevertheless not leaving contrasted lines of demarcation visible.

The solution provided by the invention opens the door to creativity. The user can easily experiment with a large number of possibilities and thus seek out a makeup result that the user finds most satisfactory.

In an implementation of the invention, the method comprises:

- making at least two measurements of the color (or the gloss) of the skin or the lips at different locations; and
- automatically forming on the skin or the lips, between the two locations, a deposit of color (or gloss) that varies and that, substantially at said locations, corresponds to the measured color (or gloss).

A color is said to "correspond" when the color difference $\Delta E$ as measured in the CIE Lab 1976 colorimetric space is not very visible to the naked eye, in other words $\Delta E$ is less than or equal to 2.

Gloss is said to "correspond" when the gloss difference is not very visible to the naked eye. A ratio R is defined as the ratio of specular reflection over diffuse reflection, which ratio can be measured firstly by illuminating the skin with directional light at a given angle, and secondly by measuring the light flux reflected at various different angles. The ratio R for the skin after deposition should be equal to within ±20% to the ratio R of the skin before deposition, at the same location.

The term "substantially" when applied to a location should be understood as being that the deposit is formed close to or exactly at the location where color or gloss were measured, e.g. at a distance of less than 2 centimeters (cm) from said location, and preferably at a distance of less than 0.5 cm.

The color or the gloss of the skin may be measured at a plurality of pairs of locations that are opposite in pairs, e.g. 1 to 1,000,000 pairs of locations. The locations where color or gloss is measured may be situated on disjoint parallel lines or on a line of closed outline, for example.

Deposition may be performed by printing, for example by using an ink jet or minispray printing technique.

The locations of a pair of locations where color or gloss is measured may be spaced apart from each other by a distance that is greater than or equal to 1 cm, preferably greater than 3 cm. Color variation $\Delta E$ of the deposit on going along a line interconnecting those two locations may be greater than or equal to 2 in absolute value, or even 5 or 10, for example.

Between the two locations, color may vary in saturation (S), hue (h), and/or lightness (L), in linear or other manner. When hue varies, it is varied by varying one or more color components, e.g. one of the red, green, or blue (R,G,B) components.

One component may vary for example by a factor of at least 1.1, 1.2, 1.5, 2 or more.

At least one colorimetric coordinate of the deposit or the gloss of the deposit may vary monotonically between the two locations along a straight line interconnecting them. At least one colorimetric coordinate of the deposit or the gloss of the deposit may pass through a single extremum along the straight line interconnecting the two locations.

The device used may be arranged to store data in memory so as to be able to reproduce a makeup result automatically on a subsequent occasion, thus enabling a user to apply the same makeup every day without difficulty. Changing makeup from one day to another also becomes very easy. No manual skill needs to be learnt for applying the makeup. This limits the risk of a user settling down into a routine, as is often the case, and making do with a single result, merely because the user has learnt one technique.

The user can thus discover several attractive makeup "looks" and switch one from another very easily, e.g. by selecting a makeup look on the apparatus.

In addition, the solution provided is wide open and, in certain implementations of the invention, makes it possible to receive makeup looks from friends or professionals and to send suggestions to other people. The invention may thus encourage the transmission of ideas and improve the appearance of results.

Other exemplary embodiments of the invention also provide apparatus for making up the skin or the lips, the apparatus comprising:

an acquisition system enabling at least one optical characteristic of the skin or the lips to be measured at least one location and preferably enabling the color of the skin or the lips to be measured at least two locations that are spaced apart from each other;

a printer system for printing on the skin in a zone spaced apart from the location where the measurement was made, preferably a zone situated between the locations where the color measurements were made; and a processor unit for receiving data from the acquisition system and for controlling the printer system at least as a function of said data;

the printing being performed with an optical characteristic that varies, e.g. a color that varies, tending towards the measured optical characteristic, e.g. tending towards the measured color, on approaching the location where the characteristic was measured.

The acquisition system may include at least two color sensors, better at least two rows of sensors.

The apparatus may comprise a handpiece including the acquisition system and the printer system.

The printer system may be an ink jet system or any other system configured to apply a composition onto the keratinous materials.

The apparatus may include at least one screen for displaying an image and an interface for enabling the user to confirm printing of the image by the printer system, before printing begins.

The apparatus may include an interface enabling one or more pixels of the image to be modified before printing.

The apparatus may be provided with a system that provides information concerning proper positioning of the sensors on the skin, in particular that detects the absence of any gap, and concerning proper positioning of the printer system on the skin. Thus, if the handpiece is no longer in contact with the skin, printing is stopped.

The apparatus may put printing on hold so long as the color sensors have not stabilized, and/or it may restart the color sensors as often as necessary until the measured colors become stable. Printing may be launched only after the colors have been stable. If a value from a sensor does not stabilize, then the color capture corresponding to said sensor is not taken into account, for example.

The apparatus may be provided with an interface enabling information to be sent or received, whether with an apparatus of the same type or with other types of apparatus, by means of a suitable network, e.g. the Internet or the telephone network.

By way of example, to use the apparatus, the user applies the handpiece to the skin that is to be treated and triggers capture, or, where appropriate, capture may alternatively be initiated automatically as soon as the apparatus detects that it has been placed on the skin.

When the apparatus displays a simulation of the result of printing on the screen, the user may look at the result proposed by the apparatus and, possibly after modification or retouching, the user may launch printing.

Where appropriate, the user may print the same image again without restarting capture or calculations, by calling on the memory of the apparatus.

The user may also make use of a symmetry function to print or reprint a mirror image. The processor unit may thus be used to apply mirror reversal to an image prior to printing, e.g. to apply makeup symmetrically on both sides of the face.

BRIEF DESCRIPTION OF DRAWINGS

The invention can be better understood on reading the following detailed description of non-limiting implementations thereof, and on examining the accompanying drawings, in which:

FIG. 1 is a diagram showing an element of a zone Z made up by implementing the method of the invention. By way of example, this zone Z is situated on the face, e.g. on a cheek, and the makeup seeks to obtain a "rosy cheek" effect.

Naturally, the method of the invention may be applied to other zones of the face or the body in order to obtain other types of makeup results.

Figure 3:
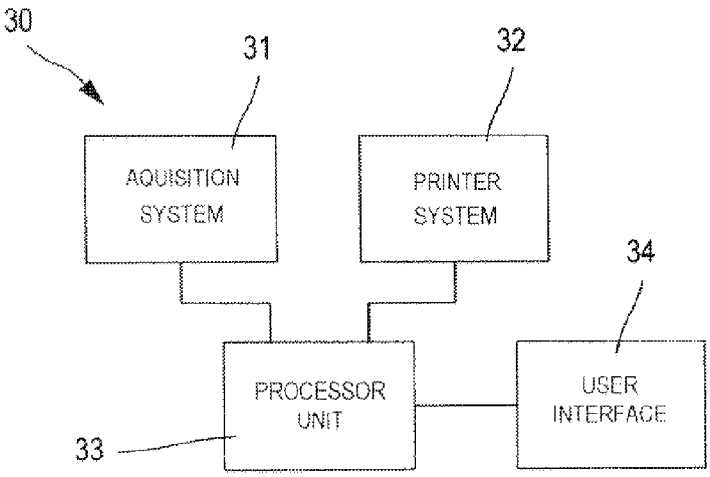
FIG. 3 is a block diagram showing diagrammatically and in part various entities of an apparatus configured for implementing the invention.

The invention may be implemented by means of apparatus 30 comprising, at shown in FIG. 3, an acquisition system 31, a printer system 32, and a processor unit 33 for processing data coming from the acquisition system 31 and for automatically controlling the printer system 32.

Figure 1:
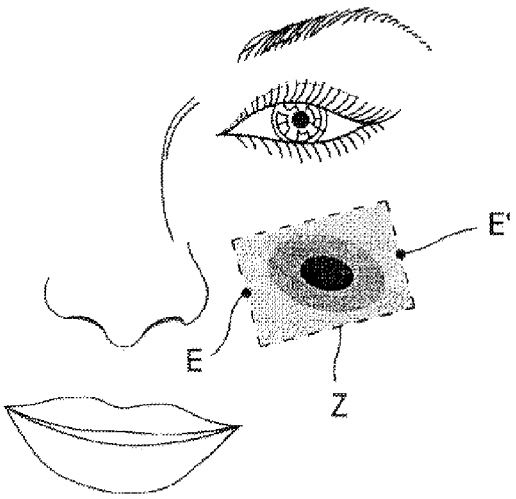
FIG. 1 is a diagram showing one example of a makeup result obtained by implementing the invention.
Figure 2:
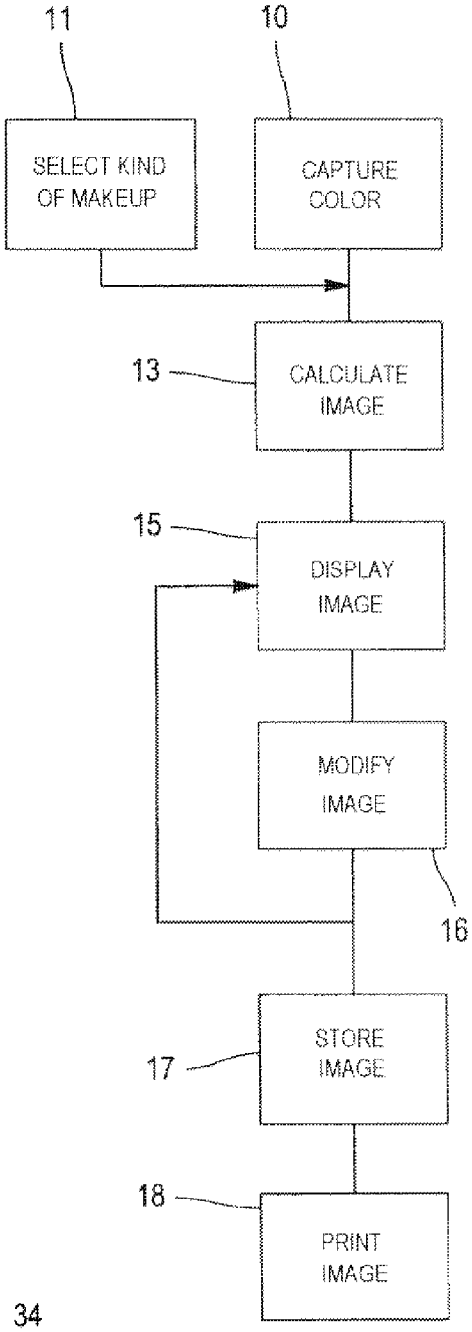
FIG. 2 is a block diagram showing the various steps of an implementation of the method of the invention.

As shown in shown FIG. 2, the method of the invention comprises a step 10 of capturing the color of the skin or the lips at least two mutually spaced-apart locations, preferably two opposite locations, e.g. two locations E and E' situated at the periphery of the zone Z, as shown in FIG. 1.

Color is preferably measured at a plurality of points around the entire periphery of the zone Z, e.g. at a number n of points lying in the range 6 to 250,000. This color capture is performed using the acquisition system 31.

The method of the invention also includes a step 11 of selecting a kind of makeup to be performed with the apparatus 30, which step may take place before or after the step 10 of capturing color.

For example, the user may select one particular kind of makeup selected from a plurality of kinds preprogrammed in the apparatus 30 or received from an external source, e.g. from another apparatus, a server, a microcomputer, or a portable telephone. The processor unit 33 may be configured to receive data from another apparatus or from a computer network.

The method of the invention includes a step 13 of calculating an image for printing in the zone 2 so that, in accordance with the invention, the color of the resulting deposit corresponds substantially at the periphery of the zone Z to the measured color, so as to reduce the visibility of the boundary between the made-up zone Z and the skin surrounding said zone that is not made up or that is made up differently.

In an implementation of the method of the invention, it may include a step 15 of displaying the image that results from the calculation, ready for printing. Where appropriate, there may be proposed to the user a step 16 of modifying this image, if the result is unsatisfactory or if the user desires to work on it, and a step 17 may also be proposed of storing the image in memory, in particular for the purpose of reproducing the same makeup look at a later time. The steps 15 and 16 may be omitted, particularly in the absence of display means.

The image selected for printing may be stored automatically, either in a memory that is internal to the apparatus, e.g. forming part of the processor unit, or else in a memory that is external to the apparatus.

The method of the invention also includes a step 18 of printing the image that results from the calculation in the zone Z.

Figure 4:
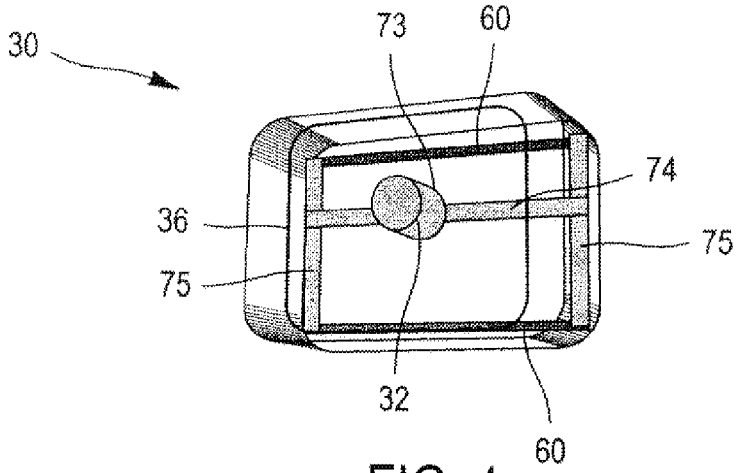
FIG. 4 is a diagrammatic and fragmentary perspective view of an example of a handpiece made in accordance with the invention.

Advantageously, the apparatus 30 includes a user interface 34, e.g. comprising, as shown in FIG. 4, a screen 36 and various input means such as buttons for example enabling the user to transmit information to the apparatus.

As shown in FIG. 4, the apparatus 30 may be in the form of a handpiece that includes the acquisition and printer systems 31 and 32 and also the processor unit 33 and the user interface 34.

Figure 5:
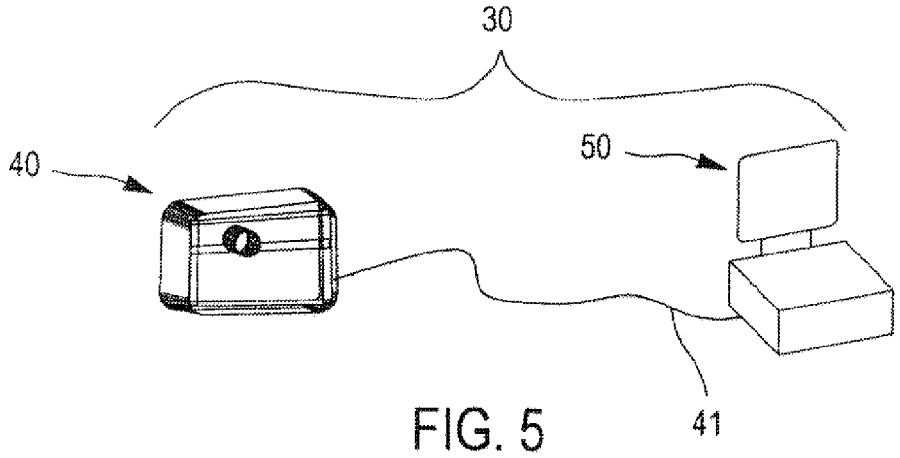
FIG. 5 is a diagrammatic and fragmentary perspective view showing a variant embodiment of the apparatus.

As shown in FIG. 5, the apparatus 30 may alternatively be in the form of a handpiece 40 and a base station 50 that is connected to the handpiece 40 via connection 41, that may be wired as shown, or wireless. The base station 50 may include all or part of the processor unit or may act solely as an interface.

Acquisition System

The acquisition system 31 comprises one or more sensors capable of transmitting information to the processor unit 33 relating to observed color.

The apparatus may include at least two color capture zones that are spaced apart from one another, which spacing may be fixed or variable.

Color measurements may be performed at different pairs of locations by means of respective pairs of sensors, which sensors may be stationary relative to one another on the apparatus and suitable for belonging respectively to said capture zones.

As shown in FIG. 4, the acquisition system 31 may have two capture lines 60 that are space apart from each other, e.g. extending parallel to each other. Each capture line 60 has a succession of sensors capable of measuring color locally, e.g. 1 to 1,000,000 sensors. The capture lines 60 may be straight lines.

By way of example, within a capture line, resolution may be better than 1 cm, i.e. the capture line is capable of measuring color locally at least once every centimeter.

Figure 6:
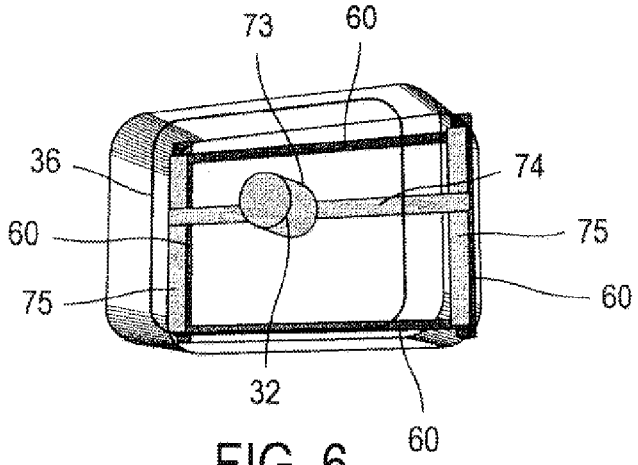
FIGS. 6 and 7 are views analogous to FIG. 4 showing other variant embodiments.

As shown in FIG. 6, the apparatus may have a plurality of capture lines 60 extending around a rectangular outline, however other dispositions are possible without going beyond the ambit of the present invention, e.g. they could occupy a circle or an oval, with the capture line(s) advantageously being disposed in such a manner as to enable color to be measured at pairs of opposite points.

Figure 8:
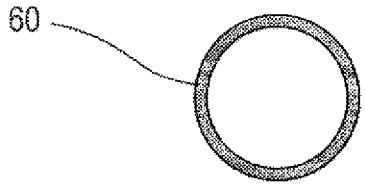
FIG. 8 shows color capture at two diametrically-opposite locations.

FIG. 8 shows a capture line in the form of a circle, thereby enabling color to be measured at pairs of diametrically-opposite points.

The printer system 32 may be arranged to print within the zone defined by the capture line(s), as shown in FIGS. 4 and 6.

Figure 7:
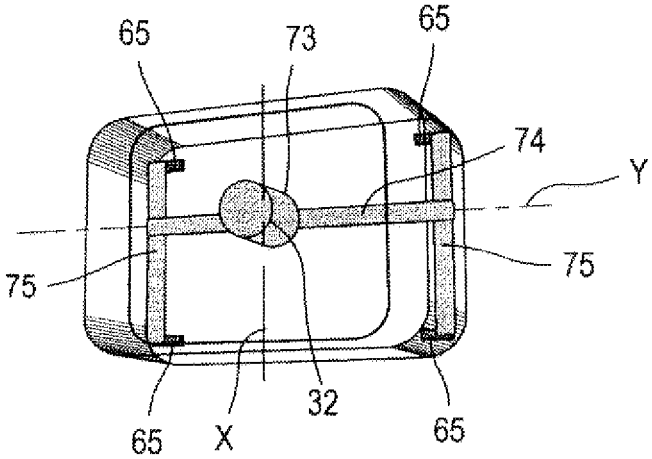

FIG. 7 shows the possibility of the acquisition system 31 performing color measurements from four capture zones 65 situated in the corners of a face of the handpiece that is designed to be pressed against the skin.

When the apparatus acquires color from sensors disposed opposite each other about the zone that is to be treated, the distance between the sensors may vary for example, over the range of a few millimeters, e.g. in order to treat bags under the eyes, to a few tens of centimeters, e.g. for making up the back. Thus, it is possible to have a distance between the sensors lying in the range 0.5 cm to 8 cm, better in the range 2 cm to 8 cm.

Color acquisition may be implemented using capture zones, e.g. each comprising 1 to 10,000 sensors per centimeter, e.g. 16 to 2500 sensors per centimeter, these capture zones possibly being implemented in the form of sensor strips, e.g. of charge-coupled devices (CCDs), of complementary metal oxide on silicon (CMOS) devices, or a focal plane array (FPA), or of electron multiplying charge-coupled devices (EMCCD), i.e. CCD with amplification within each pixel where the number of electrons is multiplied as in an avalanche photodiode. It is also possible to use an intensified camera, i.e. comprising a camera having light intensifier placed in front of it, e.g. comprising a microchannel wafer or a tube camera. As examples of such sensor strips, mention can be made of those available by the supplier E2V and used in Eliixa UC 8 cameras or those from the supplier Dalsa and referenced ILC6.

The apparatus may include sensors responsive to white light together with associated lighting means enabling the skin to be lighted using different colors, such lighting means being light-emitting diodes (LEDs), for example.

In a variant, the apparatus may include sensors that are responsive to a single color component, e.g. red, green, or blue.

By way of example, it is possible to use three rows of sensors each having 16 to 4096 sensors, with each of the rows being provided with a given color filter.

Figure 9:
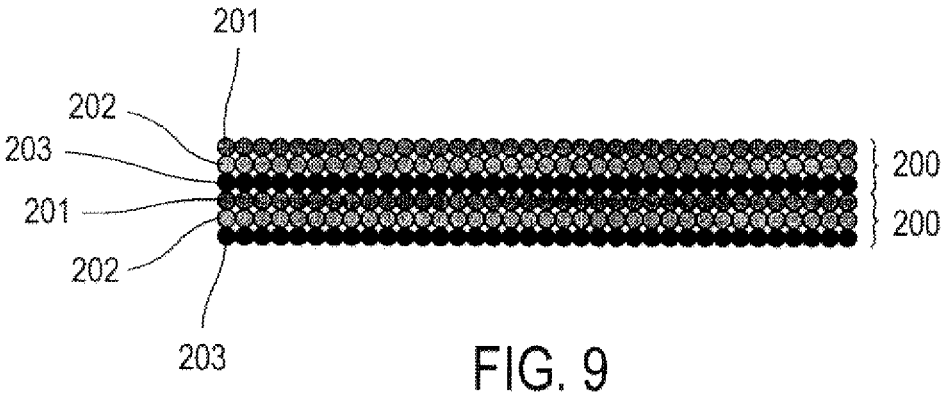
FIG. 9 is a diagram of an arrangement of color sensors for acquiring color.

As shown in FIG. 9, it is also possible to use juxtaposed triplets 200 of rows 201, 202, and 203 of sensors that are responsive respectively to red, to green, and to blue. Values from two sensors associated with the same color but belonging to different triplets may be averaged.

The sensors of a row may each be rectangular in shape and disposed in such a manner as to be juxtaposed via their short sides. This increases the quantity of light without loosing resolution (number of pixels per centimeter along the row).

In addition to three rows of sensors associated with respective color components, e.g. red, green, and blue, the acquisition means may also include a row of sensors that are not color specific. This applies for example to Eliixa UC 8-Monochrome (E2V) cameras that have four rows of sensors, i.e. red, green, and blue (R, G, and B) rows together with an additional achromatic row having a response spectrum extending from 250 nanometers (nm) to 650 nm. This can enable skin lightness to be better evaluated.

The distance between the centers of the sensors (pixels) within a capture zone may lie in the range 10 micrometers (μm) to 50 μm, for example. By way of example, one sensor (pixel) may have a short side of about 10 μm.

The use of a plurality of linear sensors or of a matrix sensor may be advantageous with skins that are very non-uniform, thereby enabling color non-uniformities to be smoothed and enabling an average color to be calculated for each point. For this purpose, during acquisition, the apparatus may recognize that acquisition points over a zone of the skin of greater or lesser extent present colors that differ from one another. During printing, the apparatus can smooth out these differences by appropriate mathematical processing.

In a variant, once acquisition has been performed, the apparatus may put itself into a mode in which it combines the acquisition points electronically or by data processing so as to retain only acquisition points of average color obtained by averaging a plurality of points. Thus, during printing, the apparatus produces a rendering that smoothes out color differences.

Skin color may be acquired with the distance between the sensor(s) and the surface of the skin that is fixed or adjustable, e.g. lying in the range 1 millimeter (mm) to 10 mm.

The acquisition means may be limited to acquisition in the visible. In a variant, the acquisition means may be capable of performing acquisition not only in the visible, but also in the infrared (IR) or the ultraviolet (UV), by using one or more sensors responsive to the infrared or the ultraviolet. By way of example, it is possible to use the acquisition means of the kind used in Eliixa UC8-NIR (E2V) cameras that include not only R, G, and B rows but also a row of sensors that are responsive in the near infrared (800 nm to 1100 nm). If the apparatus detects zones that are cold, i.e. that emit little IR, then the apparatus may for example increase contrast to obtain a more vivid effect.

The lighting associated with the sensor(s) is preferably directed so that the light illuminating the skin is reflected towards the sensor(s). The angle of incidence of light on the skin may be a grazing incidence. Where appropriate, the angle of incidence is adjustable, either automatically or by the user. The lighting may be continuous or intermittent or pulsed. Color capture may be controlled electronically, in particular when using pulsed lighting.

The gloss of the skin may be measured and printing may take this gloss into account, e.g. by using an ink that delivers glossiness. The lighting may be polarized, and processing may be performed either to eliminate gloss, or to isolate it, for measurement purposes.

Color capture may be performed continuously in an analog mode. When using digital capture, the capture rate may lie in the range 1 hertz (Hz) to 1 megahertz (MHz), e.g. in the range 100 Hz to 100 kilohertz (kHz).

If lighting is provided with three color components, then the switching on and off of the lighting may be controlled electronically. This may enable the same sensors to be used for acquiring different color components of the skin, e.g. a line of achromatic sensors.

Optical components may be situated close to the lighting and/or the sensor(s) in order to improve the efficiency and the accuracy of capture. By way of example, it is possible to use one or more lenses for imaging the skin at the sensor(s), e.g. a series of microlenses such as microlenses obtained by molding a plastics material. Optical filters may be used for lighting.

The apparatus may be arranged to enable use to be made of data coming from a fraction only of the sensors. The user may desire to rely on a number of sensors that varies depending on circumstances, for example if one of the capture lines runs close to a zone of complex shape, e.g. if the apparatus comes close to the corner of the eye or if one of the capture lines passes over a blemish such as a spot or a mark. Calculations can then be performed to interpolate or extrapolate color for the locations of the skin for which color is not measured. The number of sensors in action is preferably not less than 4.

Printer Systems

Any printer technology can be used for the printer means.

Mention can be made in particular of offset printing, photogravure, flexography, silk-screen printing, pad printing, electrophotography (also known as xerography, electrostatic printing, or laser printing), thermal printing (including in particular simple thermal printing, thermal transfer printing, or thermal sublimation printing), elcography, toner jet, magnetography, ionography (also known as ion jet, electron beam imaging, or electrography), and ink jet printing (including in particular so-called "continuous ink jet" and "drop on demand" technologies).

Ink can be ejected as a jet or as droplets by a piezoelectric element, by a thermal element (bubble jet), by hot-melting, or by means of a valve (valve jet).

Mention may also be made of impact printing techniques, such as for example hammer or chain printing, needle or dot matrix printing, daisy wheel printing, thimble printing, and techniques such as minispray, gas printing, compressed air printing, liquefied gas printing, fluidized pressure printing, such as for example airbrushes or minisprays obtained by a moving part, e.g. a moving piezoelectric crystal.

The invention is better performed with contactless printing techniques, and in particular ink jet printing technologies and minispray techniques.

It is also possible to use printer means comprising a movable print element such as a sponge, a felt, a paint brush, a hollow tube, or a syringe, that contains ink that is put into contact with the skin for printing purposes. Contact time may be adjustable and may vary for example over the range $1/1000$th of a second (s) to several seconds.

The term "printing" is used to mean delivering a composition onto the surface of the material for treatment, and in particular the skin. In the meaning of the invention, printing relates to delivering the composition onto or beneath the surface for treatment. Thus, printer means using needle printing technology can enable the ink to penetrate into the stratum corneum, the epidermis, or the dermis. For this purpose, it is possible to use strong needles or brittle needles, or the like.

The printer system may have a single print nozzle or a plurality of nozzles in parallel. The printer system may have nozzles that are dedicated to respective inks, or in a variant it may have a single nozzle for ejecting a plurality of different inks in succession or mixed together while printing is taking place so as to create the color that is to be printed.

The printer system may be spaced apart from the skin so as to avoid coming directly into contact with the skin. This spacing may be fixed or adjustable. It is possible to adjust the spacing either directly, e.g. by turning a knob or by acting on an adjustment button that controls the movement of a motor, or else automatically. For automatic adjustment, the processor unit controls a motor to change the spacing.

If it is desired to perform sharp printing, the spacing can be adjusted to a small value, e.g. one millimeter or less, and conversely, if it is desired to perform fuzzier printing it is possible to adjust the spacing to a greater distance, e.g. 1 cm or more.

The printer system may include a print head capable of printing over the entire area for treatment. The print head may include for example one or more nozzles for ejecting ink.

The print head may be movable along X and Y axes, e.g. being carried by a carriage 73 that is movable along a Y axis on a rail 74, which is itself movable on sliders 75 along the direction of an X axis, as shown in FIGS. 4, 6, and 7. Printing may optionally take place during return movements of the carriage that carries the print head. The carriage may be driven by stepper motors, e.g. motors addressed directly by a universal serial bus (USB) port.

Where appropriate, the print head may move relative to the carriage 73 along a Z axis perpendicular to the X and Y axes.

The print head may be actuated mechanically during printing, e.g. by a vibrator, so as to obtain a fuzzy effect.

The handpiece may include a blower or vacuum system for accelerating drying, and/or a heater system.

When the ink deposited on keratinous material requires exposure to light radiation in order to be polymerized (e.g. UV radiation), the handpiece may include a corresponding lighting system to assist in polymerizing the ink(s) concerned.

The invention may be performed by depositing a plurality of inks of different colors in juxtaposed manner or in at least partially superposed manner. The deposited dots of these various inks may be of the same size or of different sizes.

The surface of the skin may be covered completely by the ink(s), or gaps may be allowed to remain between the deposits of ink. The inks may be applied to the skin in a screen configuration. It is possible to implement optical effects where printing is performed using a pointillism technique, e.g. using small squares, small triangles, or small dashes.

The image printed on the skin is of a color that is not solid, i.e. the printing uses at least one ink that is deposited in non-uniform manner on the surface for treatment.

The apparatus may include a verification system enabling the user or the apparatus to determine whether the printing is satisfactory or whether it needs to be continued or corrected. This verification system includes for example a microcamera or a color detector. For example, the microcamera delivers an image to a monitor screen that can be viewed by the user, or the microcamera enables image recognition to be performed by a computer that analyses the image and verifies that the overall shape, the sharpness of the lines and of colors comply with the intended design. The microcamera may be carried by the carriage of the printer.

The color detector may verify that the color obtained is properly calibrated relative to the color desired.

Inks

The inks are adapted firstly to the printing technology and secondly to the color that is desired.

The inks used are preferably fluid and may be based on water or organic solvents and may include at least coloring agents selected from natural or artificial dyes, possibly fluorescent or phosphorescent, organic and/or inorganic pigments, and mixtures thereof.

The ink may include one or more non-colored materials that provide optical effects, e.g. a fuzzy effect.

Where appropriate, one of the printed compositions may be a base coat or a top coat in order to improve retention of the inks, for example.

The coloring agent(s) and the optically active colorless agent(s) may be in a dispersion, dissolved, or in an emulsion. They may also form a mixture that is not very stable, that needs to be remixed or redispersed at the time of use.

By way of example, the inks may be contained in a cartridge or a group of cartridges that is easy to remove and replace.

One or more color ink cartridges may be used, e.g. corresponding to primary colors (red, yellow, green, blue, or cyan, magenta, yellow, and black) or to colors that are close to skin color (pink, ochre, brown, . . . ).

In an implementation of the invention, a single printer nozzle is used with a plurality of ink cartridges of predefined colors. For example it is possible to use 1 to 10,000 e.g. sixteen colored inks, representing a set of colors that are usually to be found on the skin: pale beige, yellowish beige, pinkish beige, . . . . All of the cartridges are connected to the printer nozzle, and the apparatus modulates the rate at which each of the cartridges delivers ink to the printer nozzle as a function of the color to be printed, e.g. using electrostatic microfluidic technology. With only a limited number of colors, and even when there is only one, it is still possible to obtain a shading effect either by acting on the thickness with which the color is deposited or by having dots that are more or less closely packed together and/or that are greater or smaller in size.

Shape of the Handpiece in Contact with the Skin

The portion of the handpiece that is placed on the skin, also referred to as the "contact portion", may be plane or curved, e.g. so as to match the shape of a portion of the face.

Contact surfaces that form a portion of a cylinder of a sphere are particularly liked. The shape of the contact surface may in particular be adapted to the three-dimensional (3D) shape of the non-plane outlines of the face or the body. Where appropriate, the shape of the contact portion may be made to measure, after acquiring the 3D shape of the user in the region that is to be treated.

The contact portion may be made of a material that is soft so as to deform and match closely the shape of the region of the body or the face against which it is placed.

The printer and acquisition systems may be adapted to the non-plane shape of the treated region. For example, the print head may be moved so as to follow the non-plane shape of the skin, e.g. being able to move in a direction perpendicular to the skin. Thus, the apparatus may include at least one print head configured to be moved under motor drive and electronic control in a direction that is perpendicular to the skin so as to track the outline of the skin. A distance detector and/or a contact detector may serve to ensure that the distance between the printer system and the skin is constant.

Processor Unit

The processor unit 33 serves to process the data delivered by the acquisition system 31, in particular to store the data, and it also serves to control the printer system 32.

When two rows of sensors are used, the values captured by the acquisition system may be stored for example in two series of three tables:

- a first series of three tables containing the color components for each capture point in a first row of sensors; and
- a second series of three tables containing the color components of the facing capture points in a second row of sensors.

Before or after being stored in memory, the capture values may be subjected to transformations, in particular in order to eliminate outlier values. The values may also be subjected to conversion such as analog-to-digital conversion or transformation from one format to another. Capture may make use of "binning" methods that consist in grouping together sets of measurement pixels.

Captures in various color components may be stored either in as many memory components as there are capture points, or else in a central memory, or indeed in packets, with a packet corresponding for example to a row of sensors.

It is possible to perform a plurality of capture operations at time intervals that are close together, and then to compare the most recent capture with the preceding capture or with the average of preceding captures by calculating a difference. For example, a capture may be considered as being achieved once the difference has been minimized, once it is less than 10%.

Since it is possible that color is not always well captured, e.g. because a sensor has failed or was not activated, capture may be accompanied by running a program for recalculating capture data. The program looks for data having null values or outlier values. Assuming that these points need to be "recalculated", the calculation preferably performs interpolation, i.e. starting from points surrounding the points that need to be recalculated, interpolation operations are performed, e.g. linear interpolations, for each of the color components.

After capture, the apparatus may generate an image. Once created, the image may optionally be retouched and once it has been accepted by the user, it may be printed.

Starting from the color values measured around the boundary of the zone for treatment, the apparatus may proceed to calculate colors and patterns for generating the image that is to be printed.

After calculation, the apparatus may display a simulation and allow the user either to launch printing or to reject the result or to transform it.

Calculation may also make it possible to obtain a shading-off effect and it may also an image to be obtained showing up one or more colors with the made-up area.

Calculation may be based on functions or may be the result of point-by-point transformations performed by the processor unit or by the user.

One or more patterns may be incorporated in the image, for example a design or a texture. Calculation may be performed on the basis of certain algorithms or it may rely on incorporating data that has been stored or downloaded. The level of pattern overlay may be subjected to modulation. Thus, a pattern may be incorporated in transparency, so as to be easily detectable, or so as to provide a subliminal effect. The apparatus may be arranged to enable points or patterns to be created in random manner. Thus, the apparatus may include a random number generator. This set of transformations may be incorporated in a group of calculations referred to as "creations". The transformations may apply to all or to part of the surface for printing. A plurality of effects may be combined.

The calculations performed may seek to improve or to retouch the surfaces obtained by the "creation" calculations described above. This set may be incorporated in a group of transformations referred to as "retouches".

Various examples are given below of calculations for obtaining attractive makeup results.

It is assumed that two capture lines are used, e.g. two rows of sensors extending in parallel to each other, as shown in FIG. 4.

The two capture lines measure the color of the skin.

The colorimetric data is stored for the first line in the form of triplets $R_{top}(x)$, $G_{top}(x)$, $B_{top}(x)$ and for the second line in the form of triplets $R_{bot}(x)$, $G_{bot}(x)$, $B_{bot}(x)$, where x is the address of the pixel in question along the capture line.

The colors of the image defined by these two capture liens may be calculated by creating a straight line between two facing points of said capture lines, of abscissa position x, and then giving the following colors to the points y along the line:

$$R(x,y)=R_{top}(x)+y/m*(R_{bot}(x)-R_{top}(x))$$

$$G(x,y)=G_{top}(x)+y/m*(G_{bot}(x)-G_{top}(x))$$

$$B(x,y)=B_{top}(x)+y/m*(B_{bot}(x)-B_{top}(x))$$

where m is the number of points along the line between the two facing points, and where y is the ordinate position along said line.

Where appropriate, the rendering may be improved by allocating a factor i(x,y) that affects the intensity of printing at these points.

Insofar as it is desired to avoid making the boundaries of the printed surface visible, it may be advantageous for the intensity i(x,y) to be low for points close to the edges, and thus for x close to 0, x close to n, y close to 0, and y close to m. For example, i(x,y) is a function involving Gaussian curves such that i(x,y) is at a maximum (equal to 1) when x is equal to $x_{max}/2$ and y is equal to $y_{max}/2$, and i(x,y)=0 for any line y=0 and $y=y_{max}$ and for any pixel x=0 and $x=x_{max}$ along each line y.

The use of four rows of color sensors forming a rectangle can give results that are better than when using only two rows of sensors. Under such circumstances, the two additional rows give values $R_{left}(y)$, $G_{left}(y)$, and $B_{left}(y)$ for the third row of sensors and $R_{right}(y)$, $G_{right}(y)$, and $B_{right}(y)$ for the fourth row.

The color of each point on the surface defined by the four rows of sensors may be calculated as follows:

$$R(x,y)=\tfrac{1}{2}(R_{top}(x)+y/m*(R_{bot}(x)-R_{top}(x))+\tfrac{1}{2}(R_{left}(y)+x/n*(R_{right}(y)-R_{left}(y))$$

$$G(x,y)=\tfrac{1}{2}(G_{top}(x)+y/m*(G_{bot}(x)-G_{top}(x))+\tfrac{1}{2}(G_{left}(y)+x/n*(G_{right}(y)-G_{left}(y))$$

$$B(x,y)=\tfrac{1}{2}(B_{top}(x)+y/m*(B_{bot}(x)-B_{top}(x))+\tfrac{1}{2}(B_{left}(y)+x/n*(B_{right}(y)-B_{left}(y))$$

It is possible to use an intensity factor i(x,y) as described above for each point.

When the capture line is circular or elliptical, each sensor along the line may be numbered from 1 to n, and two facing points are points i and i+n/2 for integer i and i forming part of [0,n/2], for even n.

It is possible to calculate the colors of the points on each straight line formed by t points interconnecting two facing points, e.g. as follows:

$$R(i,j)=R(i)+j/t*(R(i+n/2)-R(i))$$

$$G(i,j)=G(i)+j/t*(G(i+n/2)-G(i))$$

$$B(i,j)=B(i)+j/t*(B(i+n/2)-B(i))$$

If so required by the printer system controller, i,j coordinates are converted into x,y coordinates by conventional trignometric methods.

The calculation may also seek to cause one particular color, e.g. red, to show up or be emphasized in the zone defined by the color sensors, while ensuring that its boundaries have the same color as that of the skin so that no line of demarcation can be seen.

It is possible to act on the other components of the color or to apply a function to the components so as to cause lightness or hue to vary. It is also possible to act on the intensity of printing. The thickness of the deposit may vary over the range about 200 nm to about 1 mm.

Figure 10:
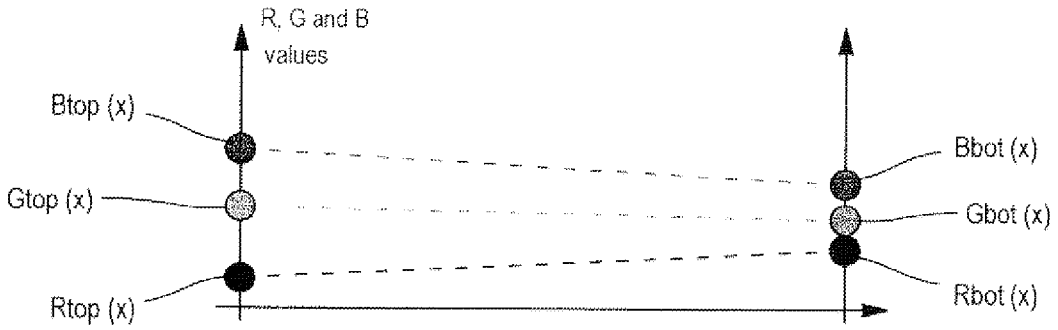
FIGS. 10 to 12 show examples of color component variation on a line interconnecting two opposite locations on the edge of the made-up zone.

The diagram of FIG. 10 shows examples of variations in the components of the R, G, B image for obtaining a shading-off effect between the opposite edges of the treated surface. The abscissa in the figure represents distance along a straight line joining together two facing points having the same abscissa position x and located in two parallel rows of sensors.

When it is desired to emphasize a color, e.g. red, a function may be applied so that the intermediate points do not follow straight lines. A function may be applied to one, two, or three color components.

Figure 11:
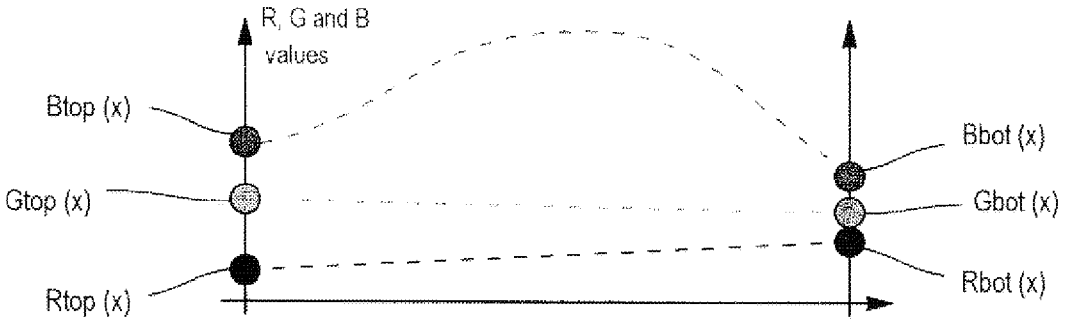
Figure 12:
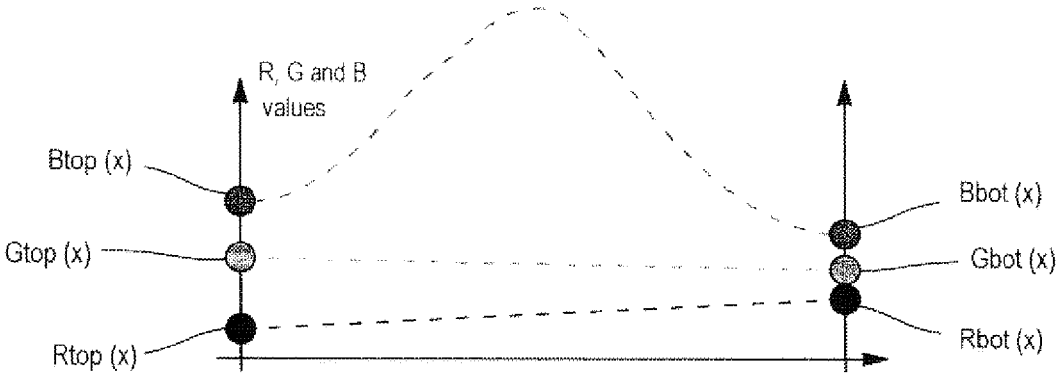

For example, in order to create an effect in which red is seen more strongly in the middle of the area, it is possible to select curves of the kinds shown in FIGS. 11 and 12 that give values very close to the colors as captured in the vicinity of the edges.

Numerous mathematical functions may be used for calculating the intermediate points, e.g. a Gaussian curve.

When printing on angular portions of the face, it is possible to apply a function that serves to limit one, two, or three color components, e.g. for the purpose of limiting the angular nature thereof or of giving a more rounded impression.

When more than one color component is varied, the functions applied to each of the components need not necessarily be identical. The appearances of the functions may differ, for example they may be multipeak, square, or triangular. Non-linear functions may be used to give the impression of a face that is angular.

The printed image may include a pattern, where a pattern is a color data set involving one, two, or three color components and is applicable to all or part of the image. The pattern may be taken fully into account (overlay) or only partially. When taken into account partially, the pattern may be perceivable in the final image. The pattern may be limited to a few points only of the image, which points may optionally be adjacent. Total or partial pattern overlay may be calculated either by adding the image and the pattern together, or by averaging the color values for the pixels of the image and of the pattern. The pattern may be encoded in the form of a set of points or in the form of a set of transformations.

For example, prior to incorporating the pattern and performing calculations to ensure that demarcation lines are not visible, the image for printing may comprise solid pink and the pattern may consist in a data set that involves the blue component of certain points of the image, e.g. varying over the range +3 to −3 depending on the point, for blue component values lying in the range 0 to 255 (extreme values). By adding the pattern to the image, the colors of certain points are changed and irregularities are created in the image, since certain points are rendered more blue and others less blue.

Prior to incorporating the pattern in the image, the processing implemented may include the step of selecting a color for the pattern so that it melds well into the image as a whole. Selecting the color for the pattern may be thought of as calibrating or recalibrating the color that is to be applied so as to reduce the color difference between the pattern and the color at the treated location. For example, if a pattern is loaded from the memory, prior to overlaying the pattern of the image, the processing may include selecting the color for the pattern. This selection may consist, for example, in taking as the color the mean color or in starting from the color of each point. It is thus possible to load a pattern in monochrome form and to allocate color to each point of the pattern. The selected color may be the color of the user's skin that is to receive the printing, for example. If the pattern represents the grain of the skin or a mark, then such skin grain or such a mark can be guessed-at in the result of adding the pattern to the image.

Conversely, the processing may seek to obtain an effect that is more clear-cut, more visible. Under such circumstances, the color may be selected so as to be different or even very different from the color of the zone being treated. For example, if the applied color is a pinky ochre, then the color selected for the pattern may be far removed therefrom: yellow, red, or quite opposite, e.g. greeny-blue.

The processing may also include selecting a color of the same type as that of the treated zone, but with different color measurement values.

The patterns may be located in an internal memory of the apparatus, they may be input via a design editor, or they may be loaded from an external memory, or indeed they may be downloaded.

In implementations of the invention, each image point may be addressed so as to retouched prior to printing, individually or collectively, manually or automatically.

By way of example, retouching may make it possible:

to find outlier points so as to eliminate them. Under such circumstances, the apparatus may propose replacing them with points of color that corresponds to the average of the color of adjacent points;

to smooth out color differences between points;

to increase contrast;

to increase or decrease the lightness of certain color components; and to increase or decrease color measurement values.

Retouching may be performed in such a manner as to comply with matching between the color at the edges of the image that is to be printed with the colors captured over the zone of the skin that is to receive the image.

Retouching may be performed over a part only of the image for printing. Thus, the apparatus may be arranged to enable the user, e.g. with the help of a mouse, to define the zone(s) in which retouching is to be performed. The remainder of the image is then not modified.

Each image may be inverted with respect to various axes or centers of symmetry. Thus, by inverting symmetrically about a vertical axis, it is possible to treat a left cheek quickly after performing capture operations on the right cheek. This function can save time when performing captures and calculations, making it possible to perform capture and/or calculation operations on only one of two cheeks and to provide symmetrical treatment for faces or for body parts that present asymmetries.

The apparatus may need to convert the image for printing into commands for the printer system, e.g. in order to adapt to the technique used for printing. Starting from the desired image, the apparatus may for example generate as many files as there are lines to be printed.

If the printer system includes a movable print head, the apparatus may combine instructions for moving the print head with information about the color that it is to deliver for each point. By way of example, these instructions may be in the form of a bitmap file.

The image with its color components for each point may be made while adding other instructions to be performed by the print head, for example concerning its Z position and/or level of intensity, . . . .

Where appropriate, the result of a calculation may be printed several times over. This enables the apparatus to be made in such a manner as to enable it to be moved and activated for printing without capturing color again. A special button for this "reprint" operation may be placed on the apparatus to make the operation easier.

The content of the memory may be conserved after the apparatus has been turned off. Any data storage system could be used, for example a USB memory key, memory internal to a computer, electrically-programmable read-only memory (Eprom), a memory card, a hard disk, optical storage.

Provision may be made for the apparatus to propose retaining some of the images for printing in its memory, e.g. by means of one or more specific buttons or by access via a suitable menu. Each of these images may be given a computer label, e.g. enabling the user to associated a color with certain portions of the body.

In an implementation of the invention, the handpiece prints on the skin on the basis of stored data sent thereto other than data coming from the acquisition system.

In a particular implementation of the invention, the apparatus does not have color sensors and prints solely on the basis of captures that are sent to its memory.

The apparatus may contain safety system such as a ground connection, a differential trip switch, a trip switch that operates in the event of a hatch being opened in the base station, or indeed in the handpiece, if there is any such hatch.

The apparatus may also calibrate color and printing so as to obtain good precision.

A warning system may act in the event of malfunction of a component or in the event of an ink being used up.

The apparatus may include a system for purging a print head after use or for cleaning the color sensors, e.g. a pneumatic system.

The apparatus may be provided with a function of detecting that it has been put into place. This function enables the apparatus to detect that is in position on the skin. This function may be performed in various ways. For example, the apparatus may be provided with contact detectors, e.g. relying on thermal conductivity, on one or more photosensors, or a pushbutton, there being four detectors, for example. When all of the detectors detect contact, when the apparatus considers that it is in position.

The apparatus may be used as an acquisition system for determining whether it is in position on the skin. Thus, before the lighting is switched on, if the color sensors do not detect light, then the apparatus may consider that it is in place.

The apparatus may include a visual or audible indicator for informing the user, e.g. that capture or printing has been completed.

The handpiece may optionally include its own internal electricity source, in the form of optionally rechargeable batteries.

PROPOSED EXAMPLE

Handpiece

A frame has been made comprising three slideways, namely a first slideway, e.g. having a length of 45 mm, on which a carriage can travel from right to left and from left to right, and a pair of slideways, e.g. having a length of 45 mm. The first slideway is held on the pair of slideways by connections enabling the first slideway to travel along the other two slideways.

The carriage travels along the first slideway under drive from a stepper motor controlled by computer. This movement is achieved by transforming rotation of the stepper via gearing and a rack system lying flush with the slideway, for example.

The first slideway travels on the other slideways under drive from a second stepper motor, likewise controlled by computer. This movement is achieved by transforming rotation of the motor into linear movement by means of gearing and a rack system lying flush with the slideway, for example.

By way of example, the two motors may be Performax models incorporating UCB interfaces.

In order to make the print head, it is possible to dismantle an ink jet printer, e.g. from the supplier Epson, and to remove the mechanics and the bodywork so as to retain only the print head together with its ink cartridges and the control electronics. The inks used should be cosmetically acceptable.

The print head may be mounted on the carriage in such a manner that the output from the print head lies close to the ventral face of the apparatus. Thus, when the carriage is moving, the print head is at all times flush with the base. The printer electronics may be mounted above the frame, at a distance such that it does not interfere with movements of the carriage. The USB output of the printer electronics is positioned on the casing of the handpiece, for example.

In order to consolidate the assembly, two horizontal bars may be fastened between the high ends and the low ends of the pair of slideways.

Under each of the two horizontal bars, it is possible to install an assembly constituted by a CCD strip having three rows of sensors (R, G, B), e.g. the strip sold under the trademark E2V Eliixa UC8 having resolution of 4×4096 pixels, encoded on 8 bits or 10 bits. Pixel size is 10 μm×10 μm, with the spacing between pixels being 20 μm. The strip has a length of 41 mm. The strip provides highly accurate capture, e.g. 1000 pixels per centimeter, and can do so at a high rate (10 kHz); a series of 8 white LEDs are also installed, which LEDs are spaced apart at 0.5 cm from one another, and a system of microlenses is also positioned so as to image the skin onto the CCD sensors. The assembly looks towards the ventral face of the apparatus.

That is all placed on a casing that covers the assembly without covering the ventral portion of the apparatus. Thus, when the apparatus is turned over, there can be seen the slideways carrying the carriage and the print head, together with the two optical capture zones.

The casing is provided with connectors for connecting a power supply, for powering the capture zones, the printer electronics, and the three USB connectors (two connected to the stepper motors and one to the print head electronics), and the R,G,B digital electronics of the two capture lines.

These lines deliver captured data in R,G,B data form encoded on 8 bits via a numerical connection.

Base Station

By way of example the base station contains an on-board PC type ultracompact PC 104 from the supplier Advantech, referenced PCM 4170, associated with 256 megabytes (Mbytes) of synchronous dynamic random access memory (SDRAM), a mouse, a screen, and an Internet connection, and for example having four USB extension ports.

This PC of small size (96 mm×104 mm) is:

- provided with a 32-bit input/output (I/O) card compatible with the PC 104 format supplied by the supplier Arcom under the reference IO32, connected to an 8-relay daughter card enabling it to switch the LEDs on and off;
- connected by a USB port to the print head electronics; and
- connected by two USB ports to the two stepper motors.

The PC is also provided with software enabling various functions to be performed, in particular:

- switching the LEDs on and off;
- controlling and capturing color measurements from the color sensors;
- storing the data;
- calculating a shaded-off image and displaying the result on the screen;
- acting as a user interface to make suggestions to the user concerning makeup and recording the user's choices;
- transforming the user's choice into a bitmap print file or a file of some other standard;
- with the user's agreement, launching printing by sending the print file to the print head electronics and controlling the two stepper motors so as to address each point and also cause the carriage to return; and
- after printing has been completed, returning to a standby mode enabling the user either to leave the apparatus inactive, or to restart printing, or to begin with a new capture.

The PC may also be programmed to accomplish one or more of the following functions:

- asking each user for identification;
- storing the choices of each user in memory;
- warning a user when capture is complete and printing is ready to start; and
- warning the user when printing is complete.

In the example described, the PC controls a screen and a computer. It is provided with internal memory, a hard disk, and an ADSL modem.

The white LEDs are not switched on continuously. The PC is programmed to switch on the white LEDs when starting the "capture" procedure. It switches all 16 LEDs on simultaneously. It switches the LEDs off when printing starts.

On starting, the apparatus may launch a "welcome" program. The program waits for instructions from a user.

On receiving an instruction from a user, the apparatus switches on the LEDs in the handpiece. As soon as the LEDs are on, it receives the color capture in digital form. It stores the data in two series of three tables, specifically:

- a first series of three 256-line tables referred to respectively as "TABTOPCOL-R", "TABTOPCOL-G", and "TABTOPCOL-B"; and
- a second series of three tables of the same size referred to respectively as "TABBOTCOL-R", TABBOTCOL-G", and "TABBOTCOL-B".

A second capture is undertaken 1/20 s later.

The new tables are compared with the previously-taken tables by calculating the difference. If the difference is greater than 10%, than the PC performs another capture, and so on. If the difference is less than 10%, the PC activates a program referred to as "CALCULATE_SHADING".

This subprogram "CALCULATE_SHADING" consists in opening a series of three two-dimensional tables each having 256 horizontal rows and 256 vertical columns, referred to as "SCAN_SHADING (R,G,B)".

For the table "SCAN_SHADING-R", for each column "c", the PC calculates the data for 256 rows r (r lying in the range 1 to 256), by performing the following operation: SCAN_SHADING-R(c,r)=TABTOPCOL-R(c)+r*(TABBOTCOL-R(c)−TABTOPCOL-R(c))/256.

It does the same for the two tables "SCAN_SHADING G" and "SCAN_SHADING B".

On the screen it displays a representation of the image in the form of a 256 pixel×256 pixel matrix (scaled to fit on a 17 inch screen in the form of a square of about 10 cm×10 cm on the screen). Each point (c,r) is represented by one color of the red, green, and blue color components: SCAN_SHADING-R(c,r), SCAN_SHADING-G(c,r), SCAN_SHADING-B(c,r).

At this stage, if the image is pleasing, the user may decide to instruct the apparatus to start printing, by executing the subprogram "PRINT_FILE" or the user may instruct the PC to launch a modification program "RETOUCH_FILE" or a makeup-proposing program "MAKEUP_FILE".

The program "RETOUCH_FILE" enables the user to retouch points, point by point, or in groups. Each point can be addressed for this purpose with the mouse and its lightness or color measurements can be varied by acting on the three parameters RGB. This program also makes it possible to select a set of points.

By displaying a plurality of possible modifications, e.g. increasing or decreasing the red, green, or blue components, the program makes it possible to determine what change the user seeks to implement on the selected point(s).

After selecting one or more changes, the table is updated and a new simulation is displayed on the screen.

The program "RETOUCH_FILE" in the example described also enables the user to perform smoothing functions or functions that create random portions in relief. For smoothing functions, each point is compared with its neighbors and a new matrix is calculated in which differences are minimized or maximized. Thus, each point is averaged in part, e.g. 50% of its value is averaged on the basis of a plurality of its neighbors, e.g. eight of its neighbors. To create random relief, the user inputs three factors: the number of points on which a modification is to be applied and the amplitude range, e.g. −4 to +4, of the changes that the user wishes the apparatus to implement, and also the color components that are to be involved. The PC generates random numbers of predefined amplitude and transforms the points concerning their selected color components.

The program "MAKEUP_FILE" contains two portions.

The first portion "MAKEUP_FILE_FUNCTION" proposes various calculation functions for applying interesting color effects to the image. For example, on the vertical axis, the matrix is recalculated so that the colors of the points vary in application of a Gaussian function. Thus, the two ends continue to be maintained at the level of the measured values, however the intermediate points follow a Gaussian function. This can be applied to a single one of the three color coordinates, e.g. R, to two of them, e.g. R and B, or to all three, as selected by the user. In the first configuration this will make the points in the center more red, and in the third it will make the points in the center darker. The Gaussian function may be inverted. Consequently, in the first situation the points in the center will be less red and in the third situation the points of the center will be paler.

The second portion "MAKEUP_FILE_MEMORY" proposes loading images from the memory of the apparatus or from the Internet or from an external memory.

The user may activate a "FILE_ALIGN" subprogram enabling the first line and the last line to be recalculated or modified either to make them closer to the color of the skin or to create an effect. The intermediate points (those of the lines 2 to 255) are recalculated prorata, for example. This subprogram is preferably proposed automatically after activating the subprogram "MAKEUP_FILE_MEMORY" since it can happen that a file taken from an earlier capture (and a fortiori from another person) is not aligned at the levels of the first and the last lines.

Each time that a calculation is activated by "FILE_MAKEUP_MEMORY", "FILE_ALIGN", "FILE_MAKEUP_FUNCTION", or "RETOUCH_FILE", the result may be displayed on the screen.

The display program may be arranged to be suitable for displaying various tests.

It is thus possible to enlarge or to shrink or to reduce the various views.

The user may select the calculation that is to be printed by launching the program "PRINT_FILE".

This program "PRINT_FILE" transforms the three 256×256 tables into 256 bitmap files. Each of the 256 bitmap files corresponds to a single print line. In addition to the Info-header and the color table, each of the 256 bitmap files is made up as a succession of RGB data items for the 256 points along the line.

The purpose of the "PRINT" program is to verify that the carriage carrying the print head is in the top left corner of the frame, and if necessary to move it to said corner, and then to send to the electronics via the USB port of the print head, the first bitmap file while causing the carriage to move in corresponding manner to the right. To do this, the program handles setting the first stepper motor into motion.

Once the first line has been printed, the program actuates the first stepper motor to return the carriage to the left. It also actuates the second motor to bring the first slideway down by a fraction of a millimeter.

Then, using the same method as that described above, the program sends the second bitmap file to the print head electronics while causing the carriage to move to the right, and so on until the 256 bitmap file has been sent.

After that, the program causes the carriage carrying the print head to move to the top left corner and hands control over to the "NEXT" program that waits for instructions from the user, by displaying a "store and start" screen or a "print again" screen (without capturing again), or a "stop" screen.

The invention is not limited to the examples described.

By way of example, a single color or gloss measurement may be performed with the color or gloss being caused to vary from the center of the print image towards the edges in progressive manner so that the color or the gloss at the edges corresponds to the measured color or gloss.

The expression "comprising a" should be understood as being synchronous with "comprising at least one".

The invention claimed is:

1. A method of making up skin or lips, the method comprising:

measuring at least one optical characteristic at at least one location of the skin or the lips; and automatically forming on the skin or the lips a deposit that has an optical characteristic that varies, tending towards the measured optical characteristic on approaching the at least one location so as to correspond substantially at said location, to the measured optical characteristic before deposition such that a line of demarcation between the optical characteristic of the skin or lips and the optical characteristic of the deposit cannot be viewed.

2. The method according to claim 1, the measured optical characteristic being color or gloss.

3. The method according to claim 1, wherein the optical characteristic of the skin or the lips is measured at two different locations, and the optical characteristic of the deposit varies between the two locations and corresponds to the measured characteristic before deposition, substantially at the two locations.

4. The method according to claim 3, at least one colorimetric coordinate of the deposit varying monotonically between the two locations along a straight line interconnecting the two locations.

5. The method according to claim 3, at least one colorimetric coordinate of the deposit passing via a single extremum on a straight line interconnecting the two locations.

6. The method according to claim 1, a color of the skin being measured at pairs of locations that are opposite one another in pairs.

7. The method according to claim 1, the forming of the deposit being performed by printing.

8. The method according to claim 1, color measurements and the forming of the deposit being performed by means of a handpiece that is in contact with the skin.

9. The method according to claim 3, the two locations being spaced apart from each other by a distance that is greater than or equal to 0.5 cm.

10. The method according to claim 3, a color variation $\Delta E$ of the deposit along a straight line joining the two locations together being greater than or equal to 2 in absolute value.

11. An apparatus for making up skin or lips, the apparatus comprising:

an acquisition system configured for measuring at least one optical characteristic of the skin or the lips at at least one location of the skin or lips;

a printer system configured to form a deposit on the skin or the lips in a zone other than where the measurement(s) is/are taken; and a processor unit for receiving data from the acquisition system and for controlling the printer system at least as a function of said data, the deposit having an optical characteristic that varies, tending towards the measured optical characteristic on approaching the at least one location so as to correspond substantially at said location to the measured optical characteristic before deposition such that a line of demarcation between the optical characteristic of the skin or lips and the optical characteristic of the deposit cannot be viewed.

12. The apparatus according to claim 11, the acquisition system including at least two color sensors.

13. The apparatus according to claim 11, including a handpiece with the acquisition system and the printer system.

14. The apparatus according to claim 11, including a screen for displaying an image, and an interface for enabling a user to confirm printing of the image by the printer system.

15. The apparatus according to claim 14, including an interface enabling one or more pixels of the image to be modified prior to printing.

* * * * *